US005809709A

United States Patent [19]

Ryan et al.

[11] Patent Number: 5,809,709

[45] Date of Patent: Sep. 22, 1998

[54] METHOD AND APPARATUS FOR COVERING SURFACES

[75] Inventors: James P. Ryan, Lakewood; Dale L. Sherry, Avon Lake, both of Ohio

[73] Assignee: Therm-All, Inc., North Olmsted, Ohio

[21] Appl. No.: 713,214

[22] Filed: Sep. 12, 1996

[51] Int. Cl.[6] ..... E04B 1/00

[52] U.S. Cl. ..... 52/222; 52/506.05; 52/512

[58] Field of Search ..... 52/220.7, 222, 52/506.01, 506.05, 512, 746.1, 404.1, 406.01, 406.02

[56] References Cited

U.S. PATENT DOCUMENTS

| | | | |
|---|---|---|---|
| 3,686,805 | 8/1972 | Pofferi | 52/506.05 X |
| 3,729,879 | 5/1973 | Franklin | 52/406.2 |
| 4,566,236 | 1/1986 | Pound | 52/222 |
| 4,665,670 | 5/1987 | van der Burg | 52/222 |
| 4,694,543 | 9/1987 | Conley | 52/222 X |
| 4,769,877 | 9/1988 | Conley | 52/222 X |
| 4,986,332 | 1/1991 | Lanuza | 52/222 X |
| 4,989,385 | 2/1991 | McCullough | 52/746.1 X |
| 5,001,879 | 3/1991 | Paliwoda | 52/404.1 X |
| 5,214,891 | 6/1993 | Edlin | 52/222 |
| 5,421,133 | 6/1995 | Berdan et al. | 52/404.1 |

OTHER PUBLICATIONS

"Thermax" brochure by Celotex Sep. 1995.

*Primary Examiner*—Lanna Mai

*Attorney, Agent, or Firm*—Jones, Day, Reavis & Pogue

[57] ABSTRACT

A surface covering system, e.g. for covering walls, is disclosed in which a covering member is provided including an overhanging portion. A support structure is affixed to a surface for supporting the covering member. A retaining member interlocks with the support structure and wherein these members engage the overhanging portion therebetween in an interference fit, thereby securely and removably retaining the covering member.

11 Claims, 4 Drawing Sheets

METHOD AND APPARATUS FOR COVERING SURFACES

BACKGROUND OF THE INVENTION

The present invention is directed to the field of surface covering, e.g. covering walls and the like. The present invention has particular applicability for wall covering systems in which panels of insulation are supported from the walls.

A number of previous wall and surface covering systems are known for applying flexible panels of insulation and/or ornamental material. Such systems typically entail the securement of a panel to a stud or purlin using a complex intervening structure, such as a plurality of clips and the like. Such complex intervening structures are typically very expensive and difficult to install. Also, since clip structures secure the panels in localized positions, the panels tend to not be uniformly supported. This results in an uneven distribution of the load which may "pinch" or "gather" the board material, resulting in unstable securement and an unaesthetic appearance. Also, such variations in load may affect the insulating properties and may compromise the vapor seal of the panels.

SUMMARY OF THE INVENTION

In view of the difficulties and drawbacks associated with previous wall covering systems, it would be advantageous to provide a wall system which solves the previous problems while providing a more reliable and efficient system.

Therefore, there is a need for a wall system which provides even support and uniform load distribution.

There is also a need for a wall system which does not "pinch" or "gather" the wall panels.

There is also a need for a wall system which is less complex and uses fewer components.

There is also a need for a wall system which is less expensive to manufacture and install.

These needs and others are satisfied by the method and apparatus of the present invention in which a covering member is provided which includes an overhanging portion. A support structure is affixed to a surface for supporting the covering member. A retaining member interlocks with the support structure and wherein these members engage the overhanging portion therebetween in an interference fit, thereby securely and removably retaining the covering member.

As will be appreciated, the invention is capable of other and different embodiments, and its several details are capable of modifications in various respect, all without departing from the invention. Accordingly, the drawings and description are to be regarded as illustrative in nature and not restrictive.

BRIEF DESCRIPTION OF THE DRAWINGS

The embodiments of the invention will now be described by way of example only, with reference to the accompanying figures wherein the members bear like reference numerals and wherein.

DETAILED DESCRIPTION OF THE INVENTION

Figure 1:
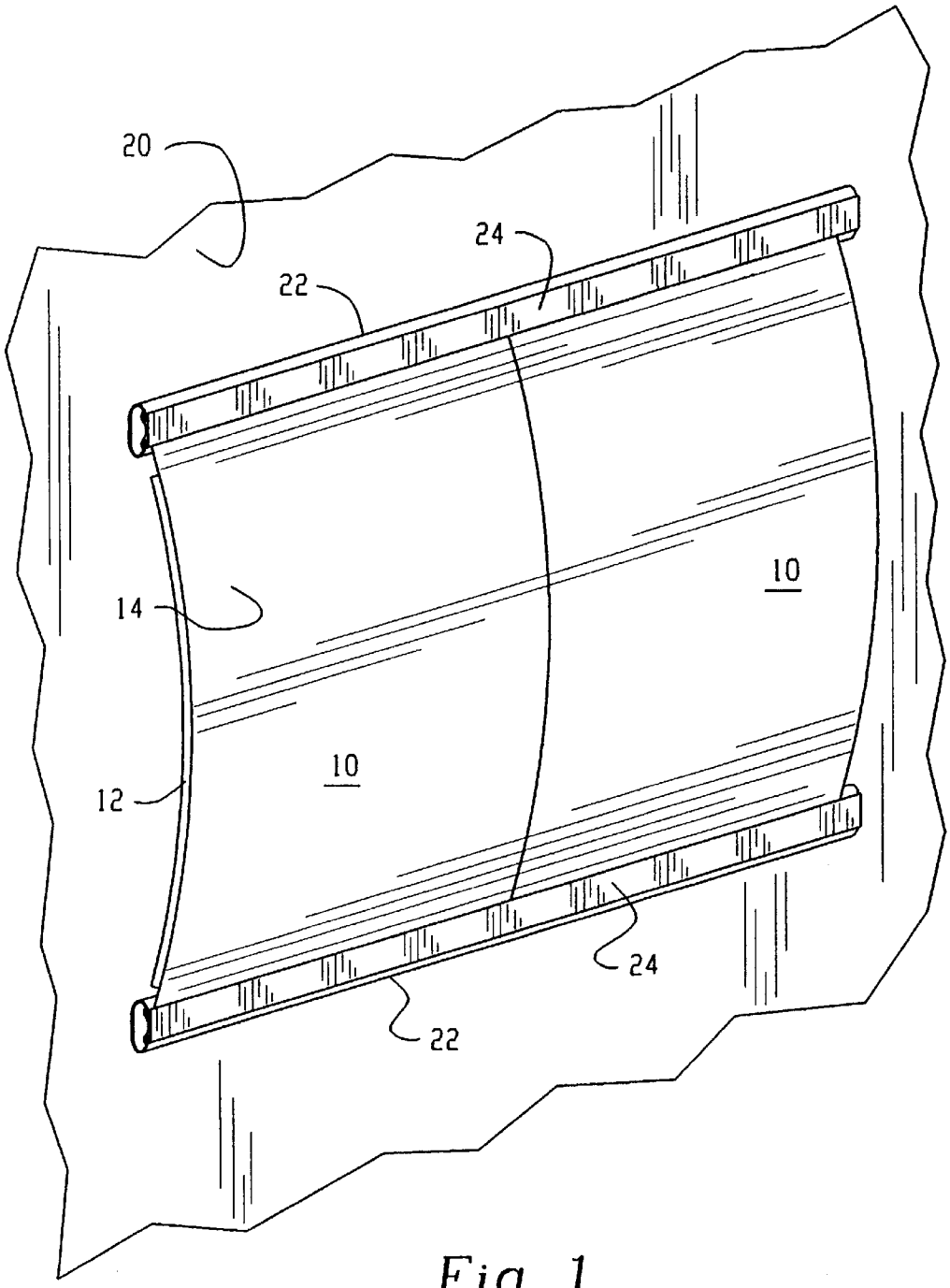
FIG. 1 is an oblique view showing an assembled wall system according to a first embodiment of the present invention.
Figure 2A:
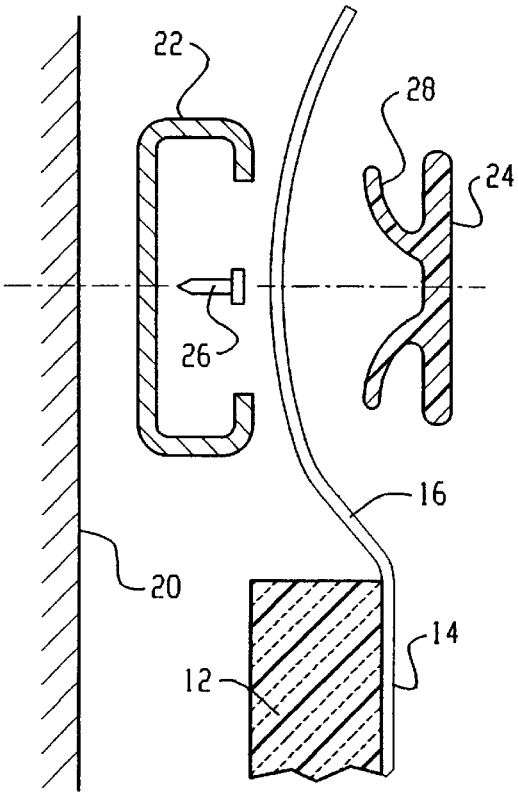
FIGS. 2A and 2B are respective exploded and side views showing the assembly of the wall system as according to the present invention.
Figure 2B:
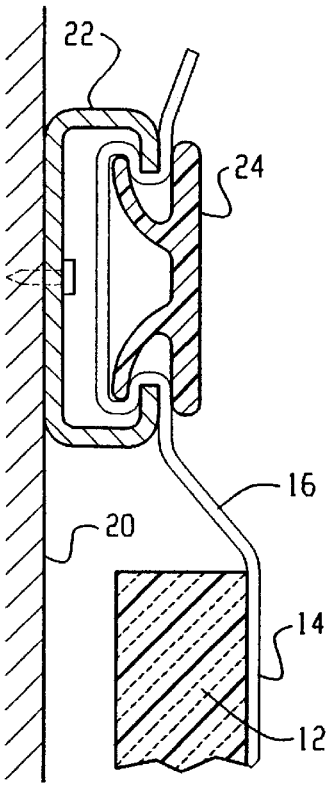

Referring now to the drawings which are for purposes of illustrating only the preferred embodiment of the present invention and not for purposes of limiting the same, FIG. 1 shows the assembled wall system and FIGS. 2A and 2B show the method of assembly as according to the present invention.

The invention includes one or more covering members 10, which are preferably a laminate such as panels of insulation having a fiberglass layer 12 and a heat-reflective facing sheet 14. The facing sheet 14 is made somewhat larger than the fiberglass layer 12 on one or more sides so as to define an overhanging portion 16.

The covering member 10 is secured to a surface 20 with one or more support members 22. In the first embodiment shown in FIG. 1, the surface 20 is a vertical wall such as is found in a building. The invention has particular applicability as used with concrete walls, such as free-standing or tiltable walls such as are common in modern building construction. Of course, it will be appreciated that the invention has applicability to other wall types and also ceilings and other surfaces.

In the preferred embodiment, the support member 22 is a longitudinally extending body having a C-shaped cross section and a central channel defined therein. The support member 22 is affixed to the surface 20 using a screw 26 or other securement (such as adhesive or lag bolts, etc.). The support member 22 can also include an intervening layer between the surface 20, such as a length of styrofoam or the like to provide additional insulation and vapor barrier. In the first embodiment shown in FIG. 1, the support member 22 is attached at the top and bottom, where the bottom is the panel area closest to the floor and the top is the panel area furthest from the floor.

The support member 22 is configured to receive a retaining member 24 within the central channel. The retaining member is also a longitudinally extending body extending substantially the length of the support member 22. The retaining member 24 preferably includes a pair of springs 28 which create a firm interference fit with the interior walls of the support member 22. Of course, any structure can be employed for producing such an interference fit without departing from the invention. In the illustrated embodiment, the support member 22 is formed of a rigid material, such as aluminum and the retaining member 24 is formed of a flexible material such as plastic. However, it is understood that members can be formed respectively of any combination of rigid and flexible materials which provide the desired interference fit and satisfactory structural integrity, all without departing from the invention.

The present wall covering is achieved by contacting the overhanging portion 16 with the channel of the support member 22. The retaining member 24 is then fitted into the channel to securely retain the overhanging portion 16. In this way, the covering member 10 is supported. In the event that the covering member 10 is not straight, or if "pinches" occur in the material, the retaining member 24 can be removed and the overhanging portion 16 can be repositioned. Any excess overhanging portion 16 extending beyond the retaining member 24 can be easily removed with a utility knife. In this way, the present invention offers a secure and removable attachment for the covering member 10 with greater flexibility than is permitted with previous wall systems.

Figure 4A:
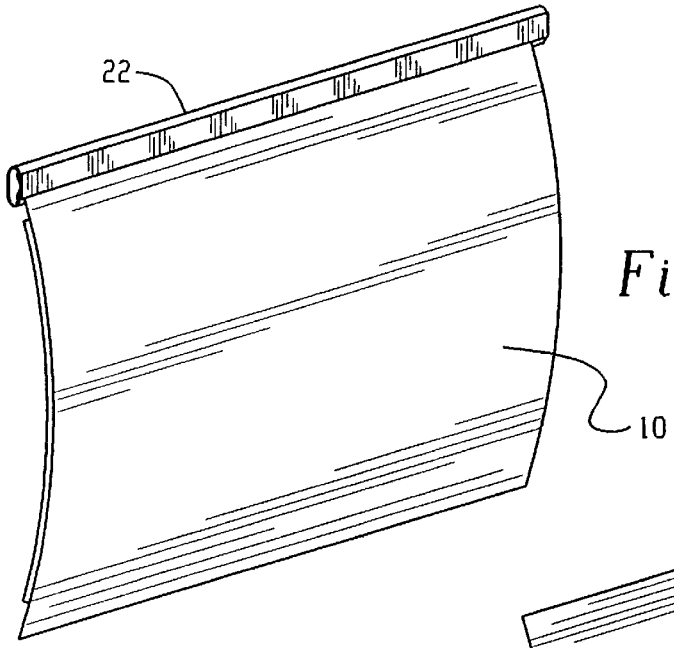
FIGS. 4A, 4B and 4C are respective frontal views showing second, third and fourth embodiments of the present invention.
Figure 4B:
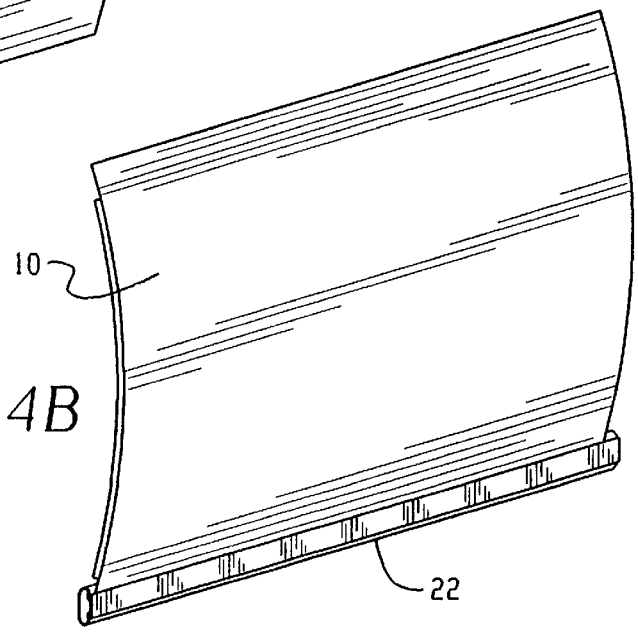
Figure 4C:
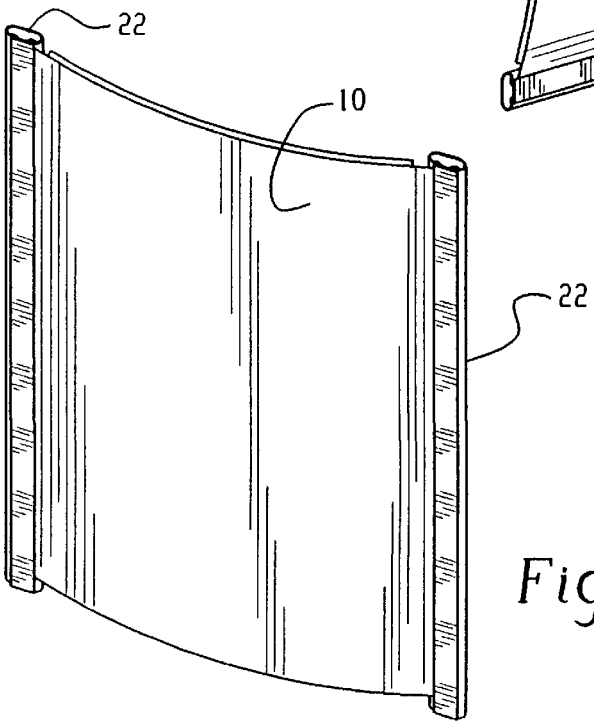

In the embodiment of FIG. 1, the support members 22 are located at both the top and the bottom, as referenced to the vertical wall surface. However, it will be appreciated that a single support member 22 can also be used, engaging the covering member 10 at the top (as shown in FIG. 4A) or at the bottom (as shown in FIG. 4B). Also, the support members 22 can also engage the covering member 10 at one or both sides (as is shown in FIG. 4C. These embodiments can also be contemplated without departing from the invention.

Figure 3A:
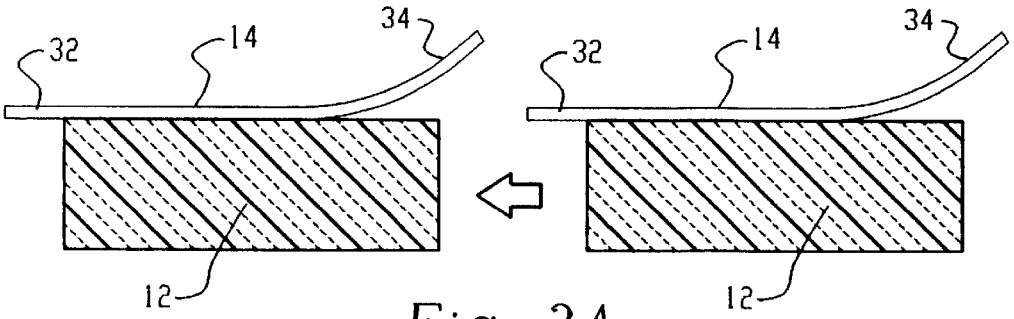
FIG. 3A and 3B are side views showing the preferred method of attachment for wall panels as according to the present invention.
Figure 3B:
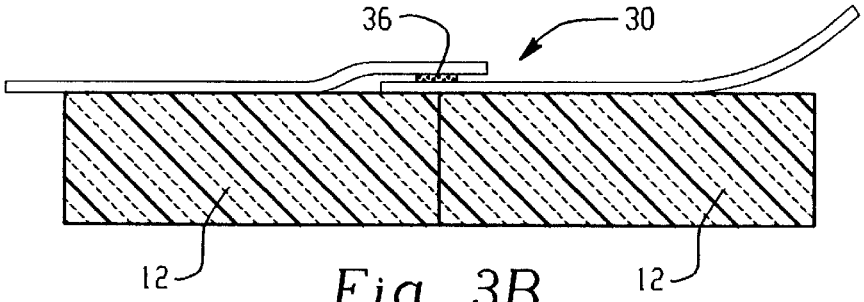

In the embodiment of FIG. 1, plural panels 10 are shown in an abutting relationship with a joint 30 running in a vertical direction. The panels 10 are preferably joined using a ConSeal Tab® as is shown in U.S. Pat. Nos. 5,085,022 and 5,001,879, both to Paliwoda, as is shown in FIGS. 3A and 3B. On each panel 10, the facing 14 is extended beyond the perimeter of the insulation layer 12 to form a tab 32. On the opposite edge, the facing 14 is unsecured to the insulation layer 12 to form a flap 34. The tab 32 of each panel is inserted into the flap 34 of the adjacent panel 10 so as to form a continuous surface with a moisture-resistant seal between panels 10. Additional securement and moisture protection is provided between the tab 32 and flap 34 by providing an adhesive layer 36, which can be double-sided tape, glue, etc. In this way, the invention provides a moisture-resistant insulating surface covering which is easy to install and maintain while being aesthetically pleasing.

Figure 5:
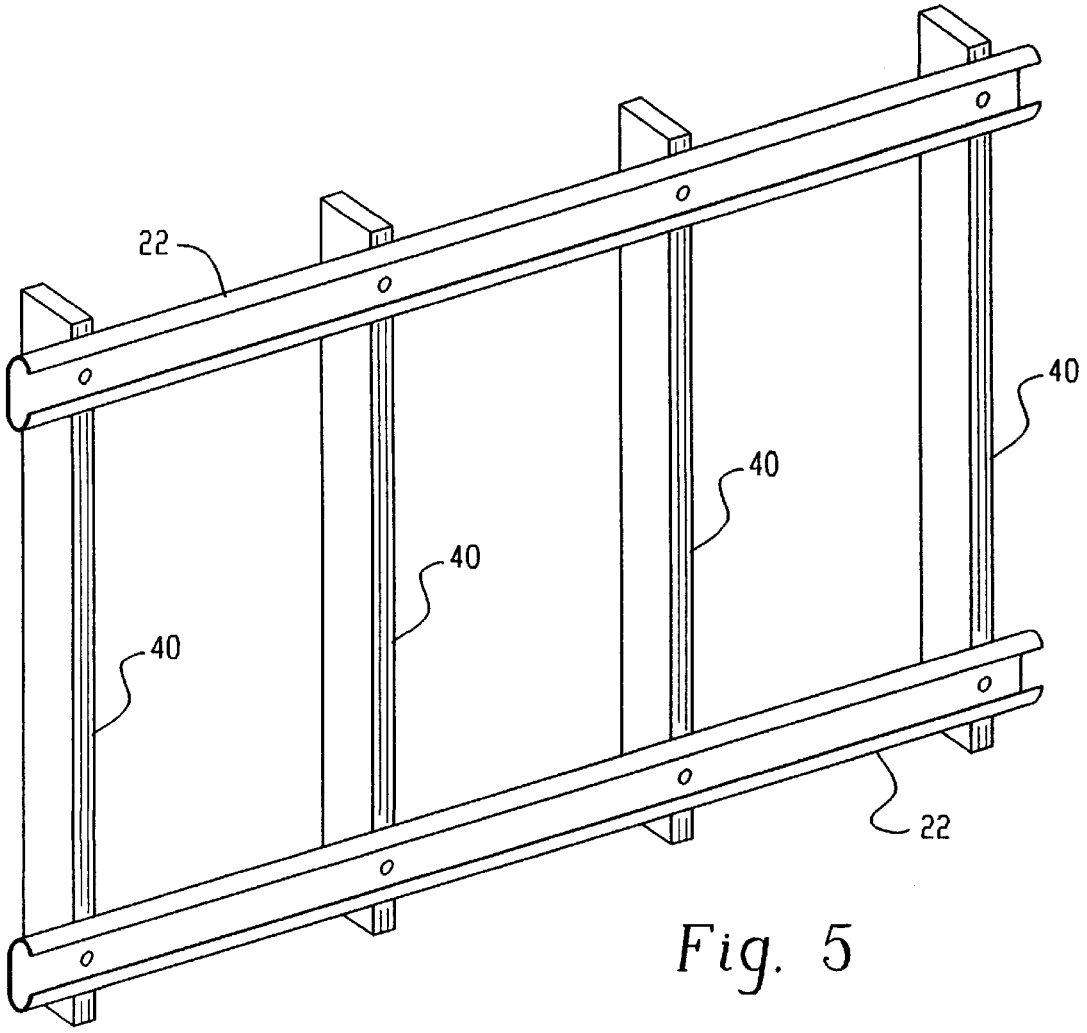
FIG. 5 shows a structural member incorporating the support member of the present invention.
Figure 6:
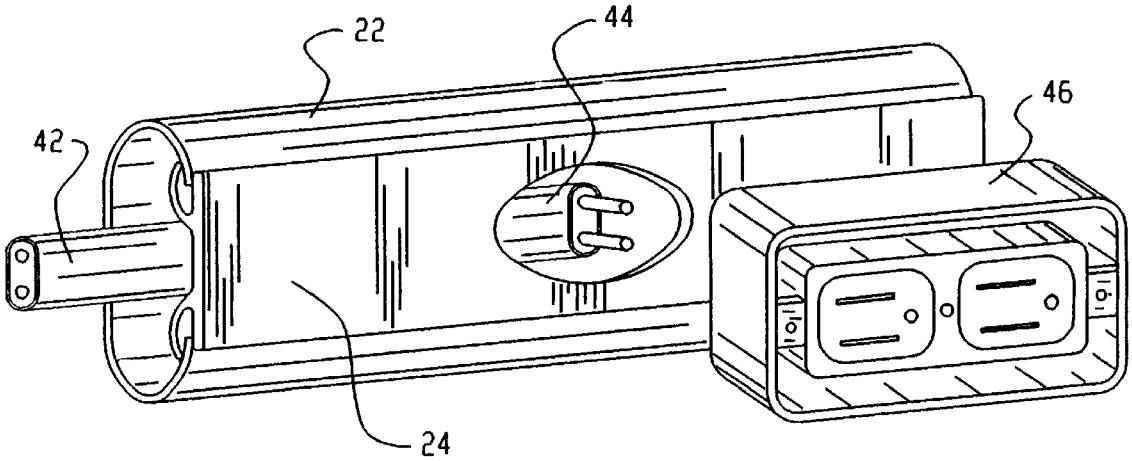
FIG. 6 shows an electrical conduit incorporating the support member of the present invention.

The support member 22 of the present invention can also be used as a structural member. As seen in FIG. 5, the present support member 22 can also be used to provide a securement between studs 40, and can thereby provide structural integrity to a wall, thereby eliminating the need for a typical cross member, and reducing the expense associated with construction. As seen in FIG. 6, the channel of the support member 22 is suitable as a conduit for electrical cable 42. The retaining member 24 can be made to include an aperture 44 for receiving and supporting an electrical box 46. In these ways, the present invention can reduce the number of components required for a construction job, and thereby significantly reduce the cost of materials and installation.

As described hereinabove, the present invention solves many problems associated with previous surface coverings, and presents improved efficiency and operability. However, it will be appreciated that various changes in the details, materials and arrangements of parts which have been herein described and illustrated in order to explain the nature of the invention may be made by those skilled in the art within the principle and scope of the invention as expressed in the appended claims.

We claim:

1. A system for covering a vertical wall comprising:

a covering member for covering said wall, said covering member includes an insulating substrate and a facing sheet, and also including at least one overhanging portion;

at least one support structure for affixing to said wall and supporting said covering member;

at least one retaining member for interlocking with said support structure, wherein said retaining member and said support structure receive said overhanging portion and interlock so as to engage said overhanging portion in an interference fit, thereby securely and removably retaining said covering member.

2. The system of claim 1 wherein the covering member is a laminate that comprises the insulating substrate and the facing sheet, wherein the at least one overhanging portion is a section of facing sheet which extends beyond the substrate's perimeter.

3. The system of claim 2 wherein the substrate is fiberglass insulation and the facing sheet is a heat-reflective layer.

4. The system of claim 1 wherein the at least one support structure comprises a strut having a generally C-shaped cross section, with a central channel for receiving said overhanging portion, and wherein the retaining member is shaped to snap-fit with the central channel.

5. The system of claim 1 wherein the at least one support structure comprises a single structure located on one edge of the covering member, wherein the one edge is selected from the group consisting of top, bottom, left and right edges.

6. The system of claim 1 wherein the at least one support structure comprises structures located respectively at the top and bottom of the covering member.

7. The system of claim 1 wherein the at least one support structure comprises a structural member for supporting a wall.

8. The system of claim 1 wherein the at least one support structure comprises an electrical conduit.

9. The system of claim 1 wherein the covering member is one of a plurality of covering members and wherein each covering member has a tab and a flap at opposite sides, and wherein each tab is received by a respective flap of an abutting covering member so as to form an integral wall surface.

10. A method of hanging a covering on a wall comprising:

providing a covering member for covering said wall, wherein said covering member includes an insulating substrate and a facing sheet, and also includes at least one overhanging portion;

affixing at least one support structure to said wall;

contacting said overhanging portion with said at least one support structure;

interlocking a retaining member to said support structure in such a way as to engage said overhanging portion in an interference fit, so as to securely and removably retain said covering member.

11. A system for covering a vertical wall comprising:

means for covering said wall, said covering means includes an insulating substrate and a facing sheet, and also including at least one overhanging portion;

means for supporting said covering means, said supporting means for affixing to said wall;

retaining means for interlocking with said supporting means, wherein said retaining member and said support structure receive said overhanging portion and interlock so s to engage said overhanging portion in an interference fit, thereby securely and removably retaining said covering member.

* * * * *